US005314636A

United States Patent [19]

Rek et al.

[11] Patent Number: 5,314,636

[45] Date of Patent: May 24, 1994

[54] LIQUID CLEANING PRODUCTS

[75] Inventors: Johannes H. Rek, Vlaardingen; Mark P. Houghton, Rotterdam; Rudolf C. Verheul, Utrecht, all of Netherlands

[73] Assignee: Lever Industrial Company, Division of Indopco Inc., Bridgewater, N.J.

[21] Appl. No.: 977,310

[22] Filed: Nov. 16, 1992

[30] Foreign Application Priority Data

Nov. 18, 1991 [GB] United Kingdom ..... 9124489

[51] Int. Cl.[5] ..... C11D 3/08

[52] U.S. Cl. ..... 252/139; 252/135; 252/156; 252/174.25; 252/99

[58] Field of Search ..... 252/135, 156, 174.25, 252/99, 139

[56] References Cited

U.S. PATENT DOCUMENTS

| | | | |
|---|---|---|---|
| 3,918,921 | 11/1975 | Pierce | 252/135 |
| 4,102,823 | 7/1978 | Matheson et al. | 252/533 |
| 4,349,448 | 9/1982 | Steele | 252/135 |
| 5,169,553 | 12/1992 | Durbut et al. | 252/99 |

FOREIGN PATENT DOCUMENTS

91/12313 8/1991 World Int. Prop. O. .

*Primary Examiner*—Paul Lieberman
*Assistant Examiner*—M. Kopec
*Attorney, Agent, or Firm*—A. Kate Huffman

[57] ABSTRACT

A substantially non-aqueous liquid detergent composition is provided comprising a liquid phase and a particulate solid phase dispersed therein, said solid phase comprising from about 10% to about 60% by weight based on the total weight of the composition of substantially amorphous sodium metasilicate containing less than 6% by weight of water.

7 Claims, No Drawings

LIQUID CLEANING PRODUCTS

FIELD OF THE INVENTION

The present invention relates to liquid non-aqueous cleaning products, especially substantially non-aqueous liquid detergent compositions containing particulate solid materials. Substantially non-aqueous liquids are those containing little or no water.

PRIOR ART AND BACKGROUND OF THE INVENTION

Non-aqueous detergent liquids have been proposed for a number of uses, such as fabric washing and dishwashing. They have advantages over powder products in that they are more rapidly dispersed in water. Further advantages over powder products are the possibility of automatic dosing and higher obtainable product densities resulting in lower transportation and packaging costs.

Non-aqueous detergent liquids have advantages over aqueous liquid products in that they are capable of including water-sensitive ingredients such as bleaches.

With regard to the use in industrial washing machines of non-aqueous liquid detergent composition containing a particulate solid phase dispersed in a liquid phase, it is important that the viscosity of such compositions should be as low as possible whilst still maintaining acceptable stability against separation of the suspended particulate solid material. The reason is that products used in industrial washing machines are usually pumped through long supply lines from the dosing equipment to the point of use inside the washing machine.

It has been described in WO 91/00282 that non-aqueous liquid detergent compositions comprising sodium metasilicate, having an improved stability against sedimentation of the particulate solid material suspended therein and having a reduced tendency to clear layer separation upon storage, can be formulated by including therein a metal oxide having a bulk density of 200 to 1000 g/l.

Detergent compositions suitable for use in industrial washing machines generally contain a considerable level of material which gives a high alkalinity in the wash liquor. This type of material is often referred to as either buffer salt or alkalinity booster, It is known that sodium metasilicate may effectively perform the function of both builder material and alkalinity booster. Therefore, sodium metasilicate is a preferred component of industrial detergent products. However, we have found that only anhydrous sodium metasilicate as a constituent of a non-aqueous liquid composition has resulted in a non-aqueous liquid with an acceptable viscosity so that it can be dosed without having to use complicated apparatus. Moreover, an acceptable viscosity of such non-aqueous liquids containing anhydrous sodium metasilicate could only be obtained at relatively low levels of particulate solids dispersed therein.

Hitherto, only crystalline forms of sodium metasilicate containing less than 5% by weight of water were applied in non-aqueous detergent product formulations. The use of an amorphous form of sodium metasilicate as a particulate solid constituent of a non-aqueous detergent liquid was considered undesirable because of the difficulty of milling non-aqueous liquids containing such sodium metasilicate. Therefore, this type of sodium metasilicate has never been used.

However, it has now surprisingly been found that incorporation of anhydrous substantially amorphous sodium metasilicate into a non-aqueous liquid detergent product results in a low viscosity, pourable, easy to process formulation. Furthermore, we have found that the use of anhydrous substantially amorphous sodium metasilicate as a component of non-aqueous liquids allows a larger amount of solids to be incorporated for obtaining formulations with a good viscosity and stability against sedimentation. In this context, substantially amorphous sodium metasilicate is defined as material which when using light or electron microscopy reveals little if any visual indication of crystals. More precisely defined, it is material that shows at most 10% by weight of material having crystalline order when applying X-ray crystallography techniques.

DEFINITION OF THE INVENTION

The present invention provides a substantially non-aqueous liquid detergent composition comprising a liquid phase and a particulate solid phase dispersed therein, said solid phase comprising from about 10% to about 60% by weight based on the total weight of the composition of substantially amorphous sodium metasilicate containing less than 6% by weight of water.

DETAILED DESCRIPTION OF THE INVENTION

All compositions according to the present invention are substantially non-aqueous liquid cleaning products. In the context of this specification, all references to liquids refer to materials which are liquids at 25° C. at atmospheric pressure.

The compositions are substantially non-aqueous, i.e. they contain little or no free water, generally less than 10% by weight, preferably less than 3% by weight, more preferably less than 1% by weight, a maximum water content of 0.5% by weight being most preferred. It has been found that the higher the water content, the more likely it is for the viscosity to be too high, or even for setting to occur. Setting is characterised by an increase in product viscosity during storage as a result of the reversible build-up of a structure within the non-aqueous liquid with time. Setting could eventually result in a product which cannot be poured or pumped without prior shaking or stirring. Preferably, compositions of the invention have a viscosity of less than 2,500 mPa.s at a shear rate of 21 $S^{-1}$, a viscosity range of 100 −2,000 mPa.s being more preferred (as measured on a Haake rotoviscometer RV20 with a mv2p head). Most preferably, the viscosity is in between 500 and 1200 mP.s at 21 $S^{-1}$, as measured using the same method.

The compositions according to the invention may be formulated in a very wide range of specific forms according to the intended use. They may be formulated as cleaners for hard surfaces (with or without abrasive) or as agents for ware washing either by hand or by mechanical means. They may also be formulated as agents for washing and/or conditioning of fabrics. Those last mentioned products constitute an especially preferred form of the present invention because in that role there is a very great need to be able to incorporate substantial amounts of various kinds of solids. These compositions may be of the kind used for pretreatment of fabrics with the composition, neat or diluted, before they are rinsed or subjected to a main wash. The compositions may also be formulated as main wash products, being dissolved and/or dispersed in the water with which the fabrics are contacted.

Thus the compositions will contain at least one agent which promotes the cleaning and/or conditioning of the article(s) in question, selected according to the intended application. Usually this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

The sodium metasilicate

The concentration of substantially amorphous sodium metasilicate in a non-aqueous liquid detergent composition according to the invention generally is in the range of 10–60% by weight of the composition.

In case no bleach compound is present in the composition, the best results in respect of the viscosity improvement as a result of the amorphous structure of the sodium metasilicate obtainable at equal total solids content or alternatively the higher total solids content obtainable at equal viscosity, were observed when the amount of sodium metasilicate included in the composition is in the range of from 40 to 60% by weight. If a bleach compound is present in the composition, the preferred amount of sodium metasilicate is in the range of from 10 to 30% by weight.

The type of sodium metasilicate applied in compositions of the invention is anhydrous substantially amorphous sodium metasilicate which most preferably consists of sodium oxide, silicon dioxide, about 0–3% by weight of carbon dioxide, and about 2–3% by weight of water, whereby the molar ratio of sodium oxide to silicon dioxide is in the range from 0.8 to 1.2. This type of sodium metasilicate typically consists of 50.5% by weight of sodium oxide, 45.5% by weight of silicon dioxide, 1.5% by weight of carbon dioxide and 2.5% by weight of water.

The water content of the substantially amorphous sodium metasilicate (as analyzed by heating a sample up to 600 ° C. during 1 hour) should not exceed an upper level of 6% by weight, more preferably 4.5% by weight, a maximum water content of 3% by weight being most preferred.

This type of sodium metasilicate may contain at most 10% by weight, preferably 1% by weight of crystalline sodium metasilicate.

The liquid and solid phase

Preferably, the detergent compositions of the invention contain the liquid phase in an amount of at least 10% by weight of the total composition. The amount of the liquid phase present in the composition may be as high as about 90% by weight, but in most cases the practical amount will lie between 20 and 70% and preferably between 35 and 50% by weight of the composition.

Preferably, the liquid phase comprises liquid nonionic surfactant. For use in fabric washing and carpet washing the liquid phase preferably contains from 30 to 50% by weight of liquid nonionic surfactant. For use in mechanical dish washing, lower liquid nonionic surfactant levels are generally applied, typically less than 10% by weight, preferably between 1 and 3% by weight of the total formulation. The rest of the liquid phase may in this case contain a solvent as described below.

The total solids content of compositions according to the invention is generally in the range of from 10 to 90%, but in most cases the practical total solids content will be in the range of from 30 to 80% by weight of the total composition, a range of from 50 to 65% by weight being more preferred. Most preferably, the total solids content does not exceed 40% by volume of the total composition.

The solid phase is generally in particulate form and usually has a weight average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus.

The dehydrating agent

The stability of a non-aqueous detergent liquid according to the invention with regard to a reduced tendency of this liquid to layering or sedimentation can further be improved by adding a dehydrating agent which has a stronger heat of hydration than sodium metasilicate. Incorporation of such an agent into a non-aqueous liquid of the invention has also resulted in a reduced sensitivity of the non-aqueous liquid to solidification on addition of small amounts of water. This is particularly advantageous when the non-aqueous liquid is intended to be applied in an industrial washing machine because large amounts of steam are often present near such washing machines.

Preferably the following compounds are applied as dehydrating agents in compositions according to the invention: calcium oxide, calcium chloride, calcium sulphate, activated zeolite, phosphorous pentoxide, sodium hydroxide and potassium hydroxide. The most preferred dehydrating agents, in this respect, are: calcium oxide and phosphorous pentoxide. It is, however realised that more solid builder material is needed if calcium salts are applied in the composition.

The level of this type of dehydrating agent in the non-aqueous liquid of the invention is preferably from 0.1 to 10% by weight of the composition, more preferably from 0.5 to 5% by weight, a range of from 1 to 4% being most preferred.

Surfactant material

Particularly when intended to be used for fabric washing, the non-aqueous liquids of the invention will generally contain one or more surfactant agents. Where surfactants are solids, they will usually be dispersed or dissolved in the liquid phase. Where they are liquid, they will usually constitute all or part of the liquid phase. However, in some cases the surfactants may undergo a phase change in the composition.

In general, surfactants for use in the compositions of the invention may be chosen from any of the classes, sub-classes and specific materials described in "Surface Active Agents" Vol. I, by Schwartz & Perry, Interscience 1949 and "Surface Active Agents" Vol. II, by Schwartz, Perry & Berch (Interscience 1959), in the current edition of "McCutcheon's Emulsifiers & Detergents" published by the McCutcheon division of Manufacturing Confectioners Company or in "Tensid-Taschenbuch", H. Stache, 2nd Edn., Carl Hanser Verlag, Munchen & Wien, 1981.

In respect of all surfactant materials, but also with respect to all ingredients described herein as examples of components in compositions according to the present invention, unless the context requires otherwise, the term "alkyl" refers to a straight or branched alkyl moiety having from 1 to 30 carbon atoms, whereas "lower alkyl" refers to a straight or branched alkyl moiety of from 1 to 4 carbon atoms. These definitions refer to alkyl species however incorporated (e.g. as part of an aralkyl species).

Nonionic surfactants

The preferred type of detergent surfactant present in non-aqueous liquids of the invention is nonionic surfactant. Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyoyl group having from 1 to 3 carbon atoms. In any of the mono- and di- alkanolamide derivatives, optionally there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or ethylene oxide and propylene oxide groups. Amongst the latter class, particularly preferred are those described in the applicants' published European specification EP-A-225,654, especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 to 7 moles of ethylene oxide. These may be used as the sole nonionic surfactant or in combination with those described in the last-mentioned European specification, especially as all or part of the liquid phase. Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183.

Mixtures of different nonionic detergent surfactants may also be used. Mixtures of nonionic detergent surfactants with other detergent surfactants such as anionic, cationic or ampholytic detergent surfactants and soaps may also be used. Generally, the level of nonionic surfactants is from 10 to 90% by weight of the composition, preferably from 20 to 70%, most preferably from 35 to 50% by weight.

Anionic surfactants

Examples of anionic detergent surfactants suitable to be included in compositions according to the present invention, are alkali metal, alkali earth metal, ammonium or alkylolamine salts of alkylbenzene sulphonates having from 10 to 18 carbon atoms in the alkyl group, alkyl and alkyl-ether sulphates having from 10 to 24 carbon atoms in the alkyl group, the alkylether sulphates having from 1 to 5 ethylene oxide groups, and olefin sulphonates prepared by sulphonation of $C_{10-24}$ alpha-olefins and subsequent neutralization and hydrolysis of the sulphonation reaction product.

Preferably the level of anionic surfactants is in between 1 and 15% by weight of the composition, more preferably between 2 and 10% by weight.

Before incorporation, all anionic surfactants will either be liquid, in which case, in the composition they will constitute all or part of the liquid phase, or they will be solid, in which case, in the composition they will either be dispersed in the liquid phase or they will be dissolved therein. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

The non-aqueous organic solvent

As a general rule, the most suitable liquids to choose as the liquid phase are those organic materials having polar molecules. In particular, those comprising a relatively lipophilic part and a relatively hydrophilic part tend to be well suited. This is completely in accordance with the observation that liquid nonionic surfactants, especially polyalkoxylated nonionics, are a preferred class of material for the liquid phase.

Non-surfactant solvents which are suitable for use in the liquid phase of compositions according to the present invention include those having the preferred molecular forms referred to above although other kinds may be used, especially if combined with those of the former more preferred types. In general these non-surfactant solvents can be used alone or in combination with liquid surfactants. Non-surfactant solvents which have molecular structures which fall into the above-mentioned preferred category include ethers, polyethers, alkylamines and fatty amines, alkyl (or fatty) amides and substituted derivatives thereof, alkyl (or fatty) carboxylic acid lower alkyl esters, ketones, aldehydes, and glycerides. Specific examples include, respectively, di-alkyl ethers, polyethylene glycol, alkyl ketones (such as acetone),and glyceryl trialkylcarboxylates (such as glyceryl tri-acetate), glycerol, propylene glycol, and sorbitol.

Detergency builders

Apart from the above-described amorphous sodium metasilicate, the detergency builder present in compositions according to the invention may include any material capable of reducing the level of free calcium ions in the wash liquor and will preferably provide the composition with other beneficial properties such as the generation of an alkaline Ph and the suspension of soil removed from the fabric. The level of the total amount of detergency builder present in compositions according to the invention may be from 10 to 70% by weight, preferably from 25 to 50% by weight.

Suitable builders comprise both inorganic and organic builders. They may also be subdivided into the phosphorus-containing and non-phosphorus-types, the latter being preferred when environmental considerations are important.

In general, the inorganic builders comprise the various phosphate-, carbonate-, silicate-, borate- and aluminosilicate-type materials, particularly the alkali-metal salt forms. Mixtures of these may also be used.

Examples of phosphorus-containing inorganic builders, when present, include the water-soluble salts, especially alkali-metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, and crystalline and amorphous silicates. Specific examples include sodium carbonate (with or without calcite seeds), potassium carbonate, sodium and potassium bicarbonates, and zeolites.

Examples of suitable organic builders include the alkali metal, ammonium and substituted ammonium, citrates, succinates, malonates, fatty acid sulphonates, carboxymetoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylene diamine tetraacetic acid, nitrilotriacetic acid, oxydisuccinic acid, melitic acid, benzene polycarboxylic acids and citric acid.

Other examples are organic phosphonate type sequestering agents such as those sold by Monsanto under the tradename of the Dequest range.

Other suitable organic builders include the higher molecular weight polymers and co-polymers known to have builder properties, for example appropriate polyacrylic acid, polymaleic acid and polyacrylic/-polymaleic acid copolymers and their salts, particularly those sold by BASF under the Sokalan Trade Mark. Other examples of suitable organic builders of this type are acrylate/methacrylate copolymers and homopolymers which may also be added as stabilisers against sedimentation and for anti-washing and anti-redeposition purposes.

The bleach system

It was found that with the afore-mentioned substantially amorphous sodium metasilicate very stable bleach containing substantially non-aqueous liquid detergent compositions could be obtained.

Bleaches which are suitable for non-aqueous compositions of the invention include the halogen, particularly chlorine bleaches such as provided in the form of alkali metal hypohalites, e.g. hypochlorites. Particularly in the application of fabrics washing, the oxygen bleaches are preferred, for example in the form of an inorganic persalt, preferably with a bleach precursor, or as a peroxy acid compound.

In the case of the inorganic persalt bleaches, the activator makes the bleaching more effective at lower temperatures, i.e. in the range from ambient temperatures to about 60° C., so that such bleach systems are commonly known as low-temperature bleach systems. They are well-known in the art. The inorganic persalt, such as sodium perborate monohydrate, acts to release active oxygen in solution, and the activator is usually an organic compound having one or more reactive acyl residues, which cause the formation of peracids, the latter providing for a more effective bleaching action at lower temperature than the peroxybleach compound alone.

The ratio by weight of the peroxybleach compound to the bleach activator is generally from about 20:1 to about 1:1, preferably from about 10:1 to about 2:1, most preferably from 5:1 to 3.5:1. Whilst the amount of the bleach system, i.e. peroxybleach compound and activator, may be varied between about 5% and about 35% by weight of the total non-aqueous liquid, it is preferred to use from about 6% to about 30% by weight of the ingredients forming the bleach system. Thus the preferred level of the peroxybleach compound in the composition is between about 5.5% and about 27% by weight, while the preferred level of the activator is between about 0.5% and 14% by weight, most preferably between about 1% and about 5% by weight.

Typical examples of suitable peroxy bleach compounds are alkali metal perborates, both tetrahydrates and monohydrates, alkali metal percarbonates, persilicates and perphosphates, of which sodium perborate and, particularly, sodium percarbonate are preferred. Preferred activator materials are TAED and glycerol triacetate.

It is particularly preferred to include in the compositions of the invention containing a bleach or bleach system, a stabilizer for the bleach or bleach system, for example ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the magnesium, calcium, zinc or aluminium salt form. The stabiliser may be present at a level of up to about 1% by weight, preferably between about 0.1 and about 0.5% by weight.

The deflocculant

Preferably compositions of the invention also comprise a deflocculant material. In principle, any material may be used as a deflocculant provided that it fulfills the deflocculation test described in EP-A-266,199 (Unilever). The capability of a substance to act as a deflocculant will partly depend on the solids/liquid phase combination. Especially preferred deflocculants are acids.

Some typical examples of deflocculants include the alkanoic acids such as acetic, propionic and stearic acid and their halogenated counterparts such as trichloracetic an trifluoracetic as well as the alkyl (e.g. methane) sulphonic acids and aralkyl (e.g. paratoluene) sulphonic acids.

Examples of suitable inorganic mineral acids and their salts are hydrochloric, carbonic, sulphurous, sulphuric, and phosphoric acids; potassium monohydrogen sulphate, sodium monohydrogen sulphate, potassium monohydrogen phosphate, potassium dihydrogen phosphate, sodium monohydrogen phosphate, potassium dihydrogen pyrophosphate.

Other organic acids may also be used as deflocculants, for example formic, lactic, amino acetic, benzoic, salicylic, phthalic, nicotinic, ascorbic, ethylene diamine tetraacetic, and aminophosphonic acids, as well as longer chain fatty carboxylates and triglycerides, such as oleic, stearic, lauric acid and the like. Peracids such as percarboxylic and persulphonic acids may also be used.

"Fatty" anions are very suitable deflocculants, and a particularly preferred class of deflocculants comprises anionic surfactants. Although anionics which are salts of alkali or other metals may be used, particularly preferred are the free acid forms of these surfactants (wherein the metal cation is replaced by an $H^+$-cation, i.e. proton). These anionic surfactants include all those classes, subclasses and specific forms described in the afore-mentioned general references on surfactants, viz. Schwartz & Perry, Schwartz Perry and Berch, McCutcheon's, Tensid-Taschenbuch.

Many anionic surfactants have already been described hereinbefore. In the role of deflocculants, the free acid forms of these are generally preferred.

In particular, some preferred sub-classes and examples are the $C_{10}$–$C_{22}$ fatty acids and dimers thereof, the $C_{8-}C18$ alkylbenzene sulphonic acids, the $C_{10}$–$C_{18}$ alkyl or alkylether sulphuric acid monoesters, the $C_{12}$–$C_{18}$ a paraffin sulphonic acids, the fatty acid sulphonic acids, the benzene-, toluene-, xylene-, and cumene sulphonic acids and so on.

The level of the deflocculant material in the composition can be optimised by the means described in the afore-mentioned EP-A-266,199, but in very many cases this level is at least 0.01%, usually 0.0% and preferably at least 1% by weight, and may be as high as 15% by weight. For most practical purposes, the amount ranges from 1–12%, preferably from 2–6% by weight, based on the total non-aqueous composition.

The antifoaming agent

In view of the foaming behaviour of compositions according to the invention good results with respect to foam reduction were obtained when using a combination of a hydrocarbon wax and an alkyl phosphate as an antifoaming agent. It appeared that good defoaming characteristics can be obtained after both separate and combined addition of these compounds to a composition of the invention. Alternatively, silicone oil based compositions containing high and low viscosity oil, particularly high viscosity silicone oil with a viscosity greater than 10000 mP.s at 25° C. and a shear rate of 21 $S^{-1}$, may be effectively used as antifoaming agents.

Miscellaneous other ingredients

Other ingredients which may be present in compositions of the invention comprise those remaining ingredients which may be used in liquid cleaning products. Examples are fabric conditioning agents, enzymes, perfumes (including deoperfumes), micro-biocides, colouring agents, fluorescers, soil-suspending agents (anti-redeposition agents), corrosion inhibitors, enzyme stabilising agents, and lather depressants.

Amongst the fabric conditioning agents which may be used, either in fabric washing liquids or in rinse conditioners, are fabric softening materials such as fabric softening clays, quaternary ammonium salts, imidazolinium salts, fatty amines and cellulases.

Enzymes which may be used in non-aqueous liquids according to the present invention include proteolytic enzymes, amylolytic enzymes and lipolytic enzymes (lipolases). Various types of proteolytic enzymes and amylolytic enzymes are known in the art and are commercially available. They may be incorporated for instance as "prills", "marumes" or suspensions.

The fluorescent agents which may be used in the non-aqueous liquid detergent products according to the invention are well known and mane such fluorescent agents are available commercially. Usually, these fluorescent agents are supplied and used in the form of their alkali metal salts, for example, the sodium salts. The total amount of the fluorescent agent or agents used in composition of the invention is generally from 0.02–2% by weight.

When it is desired to include anti-redeposition agents in a non-aqueous liquid of the invention, the amount thereof is normally from about 0.1% to about 5% by weight, preferably from about 0.2% to about 2.5% by weight of the total liquid composition. Preferred antiredeposition agents include carboxy derivatives of sugars celluloses, e.g. sodium carboxymethyl cellulose, anionic poly-electrolytes, especially polymeric aliphatic carboxylates, or organic phosphonates.

Use

Compositions according to the present invention may be used for several detergency purposes, for example the cleaning of surfaces and the washing of fabrics. For the washing of fabrics, preferably an aqueous liquor containing from 0.1 to 10% by weight, more preferably 0.2 to 2% by weight, of the non-aqueous detergent composition of the invention is used.

Processing

During manufacture, it is preferred that all raw materials should be dry and (in the case of hydratable salts) in a low hydration state, e.g. anhydrous phosphate builder, sodium perborate monohydrate and dry calcite abrasive, where these are employed in the non-aqueous composition. In a preferred process, the dry, substantially anhydrous solids are blended with the liquid phase in a dry vessel. If deflocculant materials are used, these should preferably —at least partly— be mixed with the liquid phase, prior to the addition of the solids. In order to minimize the rate of sedimentation of the solids, this blend is passed through a grinding mill or a combination of mills, e.g. a colloid mill a corundum disc mill, a horizontal or vertical agitated ball mill, to achieve a particle size of 0.1 to 100 μm, preferably 0.5 to 50 μm, ideally 1 to 10 μm, as calculated by the $D_{3,2}$ measure. A preferred combination of such mills is a colloid mill followed by a horizontal ball mill since these can be operated under the conditions required to provide a narrow particle size distribution in the final non-aqueous liquid product. Of course particulate material already having the desired particle size need not be subjected to this procedure and, if desired, can be incorporated during a later stage of processing.

During this milling procedure, the energy input results in a temperature rise in the product and the liberation of air entrapped in or between the particles of the solid ingredients. It is therefore highly desirable to mix any heat-sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in the process should preferably be completely dry, special care being taken after any cleaning operations. The same is true for subsequent storage and packing equipment.

The invention is further illustrated by the following non-limiting Examples, in which parts and percentages are by weight unless otherwise stated. In the Examples the following abbreviations are used:

Inbentin : Nonionic surfactant, $C_{10.5}$ ethoxylated alcohol containing an average of 6 EO groups per molecule, ex KOLB Synperonic A3 : Nonionic surfactant; $C_{11}$ ethoxylated alcohol containing an average of 3 EO groups per molecule, ex ICI Alf5/Wax 1:1: Defoaming agent consisting of alkyl phosphate and hydrocarbon wax, in a weight ratio of 1:1, ex LANKRO ABSA : The acid form of $C_{12}$ alkyl benzene sulphonic acid, ex Hüls MgO : Magnesium-oxide, ex Merck Amorphous SMS : Anhydrous, substantially amorphous sodium metasilicate, containing about 2–3% by weight of water, ex EKA Chemical Co Crystalline SMS: Anhydrous crystalline sodium metasilicate, containing at most 4% by weight of water, ex Rhone Poulenc SCMC : Sodium carboxy methyl cellulose;

Sokalan CP-7 : Acrylic acid/maleic acid copolymer in the sodium salt form, ex BASF CaO : Calcium-oxide, ex BAKER Chemical Co.

EXAMPLE 1, COMPARATIVE EXAMPLE A

The following non-aqueous detergent compositions were prepared by mixing the ingredients in the order stated. It will be noted that the total solid phase level remains the same in both examples. The ingredients were milled to give a mean particle size of 5 μm (by the $D_{3,2}$ measure). The tendency of the composition to give clear layer separation was determined by filling a 100 mm tall measuring cylinder with the composition, leaving it to stand without agitation for 4 weeks at 37° C. and then measuring the height of any visible distinct upper layer.

The viscosities, as measured after one week, of each composition is also given.

TABLE 1

| EXAMPLE No: | 1 Parts | A Parts |
|---|---|---|
| Inbentin | 19.55 | 19.55 |
| Synperonic A3 | 19.55 | 19.55 |
| Alf-5/Wax 1:1 | 1.00 | 1.00 |
| ABSA | 3.00 | 3.00 |
| MgO | 0.17 | 0.17 |
| Amorphous SMS | 44.50 | |
| Crystalline SMS | | 44.50 |
| SCMC | 1.50 | 1.50 |
| Sokalan CP-7 | 5.00 | 5.00 |
| CaO | 1.00 | 1.00 |
| Minor ingredients | 1.70 | 1.70 |
| Clear layer sep. (mm) | 4 | 8 |
| After 4 weeks, at 37° C. | | |
| Viscosity (mPa · s at 21 $S^{-1}$) | 960 | 1210 |

These results show that a non-aqueous liquid composition containing an amorphous sodium metasilicate has a lower viscosity and clear layer separation than a very similar non-aqueous composition containing crystalline sodium metasilicate.

EXAMPLES 2,3, COMPARATIVE EXAMPLES B,C

In a similar manner to Examples 1 and A, the following compositions were prepared. Thereafter, their viscosity was tested:

TABLE 2

| EXAMPLE No: | 2 Parts | 3 Parts | B Parts | C Parts |
|---|---|---|---|---|
| Inbentin | 20.80 | 18.30 | 20.80 | 18.30 |
| Synperonic A3 | 20.80 | 18.30 | 20.80 | 18.30 |
| Alf-5/Wax 1:1 | 1.00 | 1.00 | 1.00 | 1.00 |
| ABSA | 3.00 | 3.00 | 3.00 | 3.00 |
| MgO | 0.17 | 0.17 | 0.17 | 0.17 |
| Amorphous SMS | 42.00 | 48.00 | | |
| Crystalline SMS | | | 42.00 | 48.00 |
| SCMC | 1.50 | 1.50 | 1.50 | 1.50 |
| Sokalan CP-7 | 5.00 | 5.00 | 5.00 | 5.00 |
| CaO | 1.00 | 1.00 | 1.00 | 1.00 |
| Minor ingredients | 1.70 | 1.70 | 1.70 | 1.70 |
| Viscosity (mPa · s at 21 $S^{-1}$) | 810 | 1100 | 1360 | 1590 |

It can be derived from table 2 that a considerably greater amount of (solid) sodium metasilicate can be incorporated in a non-aqueous composition whilst still obtaining comparatively low viscosities if amorphous in stead of crystalline sodium metasilicate is applied.

EXAMPLES 4–7

In a similar manner to Example 1 and A, the following compositions were prepared and tested.

TABLE 3

| EXAMPLE No. | 4 Parts | 5 Parts | 6 Parts | 7 Parts |
|---|---|---|---|---|
| Inbentin | 19.55 | 19.55 | 19.55 | 19.55 |
| Synperonic A3 | 19.55 | 19.55 | 19.55 | 19.55 |
| Alf-5/Wax 1:1 | 1.00 | 1.00 | 1.00 | 1.00 |
| ABSA | 3.00 | 3.00 | 3.00 | 3.00 |
| MgO | 0.17 | 0.17 | 0.17 | 0.17 |
| Amorphous SMS | 44.50 | 44.50 | 44.50 | 44.50 |
| SCMC | 1.50 | 1.50 | 1.50 | 1.50 |
| Sokalan CP-7 | 5.00 | 5.00 | 5.00 | 5.00 |
| Calcium oxide | 1.00 | | | |
| Activated zeolite | | 1.00 | | |
| Phosphorus pentoxide | | | 1.00 | |
| Calcium chloride | | | | 1.00 |
| Minor ingredients | 1.70 | 1.70 | 1.70 | 1.70 |
| Clear layer sep. (mm) | 4 | 4 | 3 | 5 |
| After 4 weeks at 37° C. | | | | |
| Viscosity (mPa · s at 21 $S^{-1}$) | | | | |
| =of product, as prepared | 960 | 1080 | 970 | 1200 |
| =after adding 1 part $H_2O$ | 1700 | 2070 | 1650 | Paste |

It can be seen that the lowest clear layer separation and viscosity values were obtained when calcium oxide or phosphorus pentoxide was applied as a dehydrating agent in the non-aqueous liquid composition.

EXAMPLES 8,9

In a similar manner to Example 1 and A, the following bleach containing compositions were prepared and tested.

TABLE 4

| EXAMPLE No: | 8 Parts | 9 Parts |
|---|---|---|
| Inbentin | 19.55 | 19.55 |
| Synperonic A3 | 19.55 | 19.55 |
| Alf-5/Wax 1:1 | 1.00 | 1.00 |
| ABSA | 3.00 | 3.00 |
| MgO | 0.17 | 0.17 |
| Amorphous SMS | 34.00 | 34.00 |

TABLE 4-continued

| EXAMPLE No: | 8 Parts | 9 Parts |
|---|---|---|
| SCMC | 1.50 | 1.50 |
| Sokalan CP-7 | 5.00 | 5.00 |
| CaO | 1.00 | 1.00 |
| Minor ingredients | 1.70 | 1.70 |
| Perborate | 10.00 | |
| Percarbonate | | 10.00 |
| Clear layer sep. (mm) | 11 | — |
| After 4 weeks, at 37° C. | | |
| Viscosity (mPa · s at 21 $S^{-1}$) | 1489 | 1650 |

Due to the inclusion of the bleach compounds the level the anhydrous sodium metasilicate is reduced resulting in a less stable composition evidenced by an increased clear layer separation and viscosity. With percarbonate, clear layer separation could not be measured because of the appearance of gas bubbles in the non-aqueous liquid.

It can be seen that with both type of bleaches acceptable viscosities could obtained.

Furthermore, it was observed that with more than 3% water in the sodium metasilicate unacceptable chemical instability of both types of bleaches occurred.

We claim:

1. A substantially non-aqueous liquid detergent composition comprising:

a liquid phase having an organic polar solvent and a particular solid phase dispersed within the liquid phase, the solid phase comprising from about 10% to about 60% by weight based on the total weight of the composition of a substantially amorphous sodium metasilicate having at most 10% by weight of a crystalline sodium metasilicate and less than 6% by weight of water, wherein the non-aqueous liquid detergent composition contains less than 10% by weight of water.

2. Composition according to claim 1, wherein the amorphous sodium metasilicate contains less than 4.5% by weight of water.

3. Composition according to claim 1, wherein the amorphous sodium metasilicate contains less than 3% by weight of water.

4. Composition according to claim 1, comprising from 10% to 90% by weight of a liquid phase and from 10% to 90% by weight of a solid phase.

5. A composition according to claim 1, further comprising a dehydrating agent selected from the group consisting of calcium oxide, calcium chloride, calcium sulfate, activated zeolite, phosphorous pentooxide, sodium hydroxide and potassium hydroxide.

6. Composition according to claim 5, wherein the dehydrating agent is calcium oxide or phosphorus pentoxide.

7. Composition according to claim 1, wherein the composition further comprises a peroxygen bleach compound.

* * * * *